United States Patent [19]

Bensch et al.

[11] 3,941,100

[45] Mar. 2, 1976

[54] APPARATUS FOR PRODUCING AN ENGINE-SPEED SIGNAL FOR AN ELECTRONIC FUEL INJECTION SYSTEM

[75] Inventors: Gotthard Bensch; Gustav Ehrich; Peter Fendler, all of Wolfsburg, Germany

[73] Assignee: Volkswagenwerk Aktiengesellschaft, Wolfsburg, Germany

[22] Filed: Apr. 4, 1974

[21] Appl. No.: 458,053

[30] Foreign Application Priority Data

June 1, 1973 Germany ..... 2327801

[52] U.S. Cl. ..... 123/32 EA; 123/139 E

[51] Int. Cl.[2] ..... F02B 3/00

[58] Field of Search ..... 123/32 EA, 32 AE, 148 E, 123/139 E; 307/261; 328/20

[56] References Cited

UNITED STATES PATENTS

| | | | |
|---|---|---|---|
| 3,340,476 | 9/1967 | Thomas et al. | 328/20 |
| 3,581,723 | 6/1971 | Scholl | 123/140 MP |
| 3,685,526 | 8/1972 | Hobo et al. | 123/32 EA |
| 3,724,433 | 4/1973 | Voss et al. | 123/102 |
| 3,742,920 | 3/1973 | Black | 123/32 EA |
| 3,750,631 | 8/1973 | Scholl et al. | 123/32 EA |
| 3,782,347 | 1/1974 | Schmidt et al. | 123/32 EA |
| 3,809,029 | 5/1974 | Wakamatsu et al. | 123/32 EA |
| 3,811,420 | 5/1974 | Vogel | 123/148 E |
| 3,821,659 | 6/1974 | Ludwig | 307/261 |

*Primary Examiner*—Charles J. Myhre
*Assistant Examiner*—Paul Devinsky
*Attorney, Agent, or Firm*—Brumbaugh, Graves, Donohue & Raymond

[57] ABSTRACT

Apparatus for producing a signal representative of engine speed (RPM) for use in an electronically controlled fuel injection system. The apparatus includes means for producing a first train of pulses in which the pulse intervals are dependent upon engine speed, and a signal processor for receiving the first train of pulses and producing a second train of pulses in which the pulse intervals correspond, at least approximately, to the mean value of the pulse intervals in the first pulse train.

2 Claims, 3 Drawing Figures

APPARATUS FOR PRODUCING AN ENGINE-SPEED SIGNAL FOR AN ELECTRONIC FUEL INJECTION SYSTEM

BACKGROUND OF THE INVENTION

The present invention relates generally to electronic fuel injection systems and, more specifically, to an arrangement for producing a signal, for use in an electronic fuel injection system, which is representative of engine speed or RPM.

Various types of electronic fuel injection systems for internal combustion engines are known in the art. For example, reports in the "Motortechnische Zeitschrift" Vol. 34 (1973) No. 1 at page 7, and No. 4 at page 99, describe an electronic gasoline injection system that operates with an air volume flow meter. In this system a control device or system regulator is provided with signals which are derived from ignition pulses of the internal combustion engine and, thus, are a function of engine speed or RPM. On the other hand reports in the "Automobiltechnische Zeitschrift 73" (1971) No. 4, page 126; in "Bosch Technische Berichte 2", Vol. 3 (November, 1967) page 107, as well as in "Bosch Technische Berichte 3" Vol. 1 (November, 1969) page 3, describe a fuel injection system wherein engine speed-dependent signals are obtained by the addition of separate switch contacts on the engine distributor. With a fuel injection system in accordance with the literature passages first cited, the system control or regulator forms the quotient of the air volume measurement and the speed-dependent signal to obtain a signal proportional to the injection time; in contrast, in the injection system described in the latter-cited articles, the engine speed is only a corrective quantity.

In some motor vehicles provided with fuel injection systems of the above-described types unexplainable oscillations in the vehicle forward movement may occur under certain conditions of operation, e.g., when the vehicle is decelerated or when it is operated under partial load. However, this instability or tendency to oscillate does not occur in all vehicles of the same type and even occurs in varying degrees with the vehicles of the same type.

SUMMARY OF THE INVENTION

An object of the present invention is to provide a remedy for the condition of vehicle oscillation referred to above.

The achievement of this object is based on the discovery that variations or irregularities of short duration in the rotational speed of an internal combustion engine, both positive and negative — due to various causes such as uneven roadways or stray electrical signals in the ignition system - may cause modifications in the injection time as a result of the speed-dependent feedback incorporated into the control device or regulator of the fuel injection system. Such modifications, in turn, may lead to fluctuations in the torque delivered by the engine. The extent to which these fluctuations in torque output are manifested as longitudinal oscillations of the vehicle proper depends, in part, upon the elasticity of the spring suspension system of the vehicle; that is, more specifically, upon the mechanical, natural frequency of the vehicle suspension system. The above discovery, which was confirmed by extensive studies and investigations in accordance with the invention, explains the difference in the magnitude of the oscillation phenomena on individual vehicles of one and the same type.

Based on the above discovery, the present invention therefore resides in an arrangement for producing a signal representative of the speed or RPM of a motor vehicle engine. This signal, which is preferably a pulseposition modulated pulse train, may then be applied as an input to an otherwise conventional controller or regulator of an electronic fuel injection system.

In accordance with the invention, the arrangement or apparatus for producing an engine-speed dependent signal includes (1) means for generating a train of pulses in which the pulse intervals are dependent upon RPM, and (2) a signal processor which reduces or eliminates any pulse interval changes of short duration in the train of pulses produced by the generating means.

The apparatus according to the present invention may be employed to advantage with any type of electronic fuel injection system having a controller or regulator which processes signals that are dependent upon the instantaneous speed of the engine. The present invention may be utilized whether the electronic fuel injection system is designed to vary the injection time or the injected fuel quantity per unit time (with a fixed injection time).

It is an essential characteristic of the invention to effectively block or prevent the passage, to the controller or regulator of a fuel injection system, of speed variations having short duration which, in a pulse-position modulated signal, are manifested by a sudden change in the interval between two successive pulses. On the other hand, the apparatus according to the invention must evidently permit any longer lasting and generally less rapid variations in speed to be passed to the controller or regulator so that the fuel injection system can operate in accordance with its specifications and the fuel quantity delivered to the engine will be suitably modified according to the commands of the driver. As mentioned above, the operation of the controller or regulator of the fuel injection system requires the feedback of engine RPM by means of the aforementioned engine speed-dependent signal which, in turn, contributes to the undesirable fluctations of the engine torque.

The apparatus in accordance with the present invention might be realized in such a way as to permit the passage, to the fuel injection system controller, of any variations in the time intervals between pulses only if a variation or change continues for a predetermined duration or number of pulses. This type of apparatus would introduce a delay, however, and would result in an undesirable sluggishness in the response of the fuel injection system.

To avoid such a time delay in the transfer of a signal variation from the input to the output of the signal processor according to the invention, the signal processor is preferably designed in such a way as to form, at least approximately, the mean value of the pulse intervals occurring within a given pulse sequence. With this operation, the signal processor effectively acts as a "time filter" between the pulse generating means, on one hand, and the input of the electronic fuel injection controller or regulator on the other. That is, the signal processor functions to average out any momentarily occurring speed changes represented by the signal — as may be caused, for example, by an uneven roadway — but to transmit any longer lasting variations in speed which, in a pulse-position modulated pulse train, are represented by a change in the intervals between successive pulses.

In a preferred embodiment, therefore, the signal processor according to the invention may comprise a pulse frequency divider connected to receive input pulses from the pulse generating means; an integrator connected to receive the output of the pulse frequency divider; a pulse frequency multiplier connected to the integrator for regenerating the original pulse frequency and, finally, a trigger circuit or threshhold gate, connected to the pulse frequency multiplier, for producing an output signal whenever its input exceeds a prescribed value.

The pulse frequency divider may have a step down ratio of 2:1, in which case the pulse frequency multiplier must increase the pulse frequency by a ratio of 1:2. In principle, however, it is also possible to select other ratios. For example, the pulse repetition frequency may be stepped down to the point where all pulse intervals of short duration which occur within the period of one complete (approximately sinusoidal) longitudinal mechanical oscillation of the vehicle are suppressed. If ignition pulses are used to generate the pulse train representative of engine speed (RPM) it may be shown experimentally that about eight pulses fall within one period of the longitudinal mechanical oscillations of the vehicle. In this case, the pulse frequency divider may have a ratio of 8:1 while the pulse frequency multiplier has a ratio of 1:8. It may also be sufficient to suppress only those pulse interval variations which fall within half a period of the longitudinal oscillations of the vehicle. In this case, the pulse repetition frequency should be divided, and subsequently multiplied, by a factor of four. Finally, in many vehicles it will be sufficient that the two intervals between only three pulses in succession be combined and averaged so that the interval variations occurring within this pulse sequence are reduced in the manner described above, prior to input to the controller or regulator of the electronic fuel injection system. To accomplish this, the pulse frequency divider and pulse frequency multiplier should operate with a ratio of 2:1 and 1:2, respectively.

The use of an integrator in accordance with the invention (which may be realized with a capacitor) offers the advantage, due to the exponential behavior of its charge and discharge curves, that, notwithstanding the point at which the charge and discharge cycle for a particular pulse interval begins, the instants at which these curves pass through a defined potential have relatively little dependency upon the variations of the intervals between the original pulses. On the other hand, the dependency of these instants upon the pulse intervals is sufficient to reflect any gradual changes in the pulse intervals as may occur whenever the speed of the engine is intentionally varied by the vehicle operator.

In a particular preferred embodiment of the present invention, the pulse frequency multiplier includes at least one pulse frequency doubler consisting of two parallel rectifier branches, one of which includes a network for inverting the integrator voltage. In order to achieve different ratios for the pulse frequency divider and pulse frequency multiplier, several components for effecting a frequency division and multiplication by a factor of two may be connected in series. The inverting network in the pulse frequency multiplier shifts the negative portions of the output of the integrator to a positive value and, because the two rectifier branches are connected at their output, the fundamental frequency of the output signal of the integrator, representing the charging and discharging capacitor voltage, is doubled.

It is possible to realize the pulse frequency doubler in a simple manner with two operational amplifiers connected in parallel, only one of which is connected as an inverter. Another way to realize such a circuit is to provide two rectifier branches, only one of which contains a transistor connected as an inverting amplifier.

DESCRIPTION OF THE PREFERRED EMBODIMENT

Figure 1:
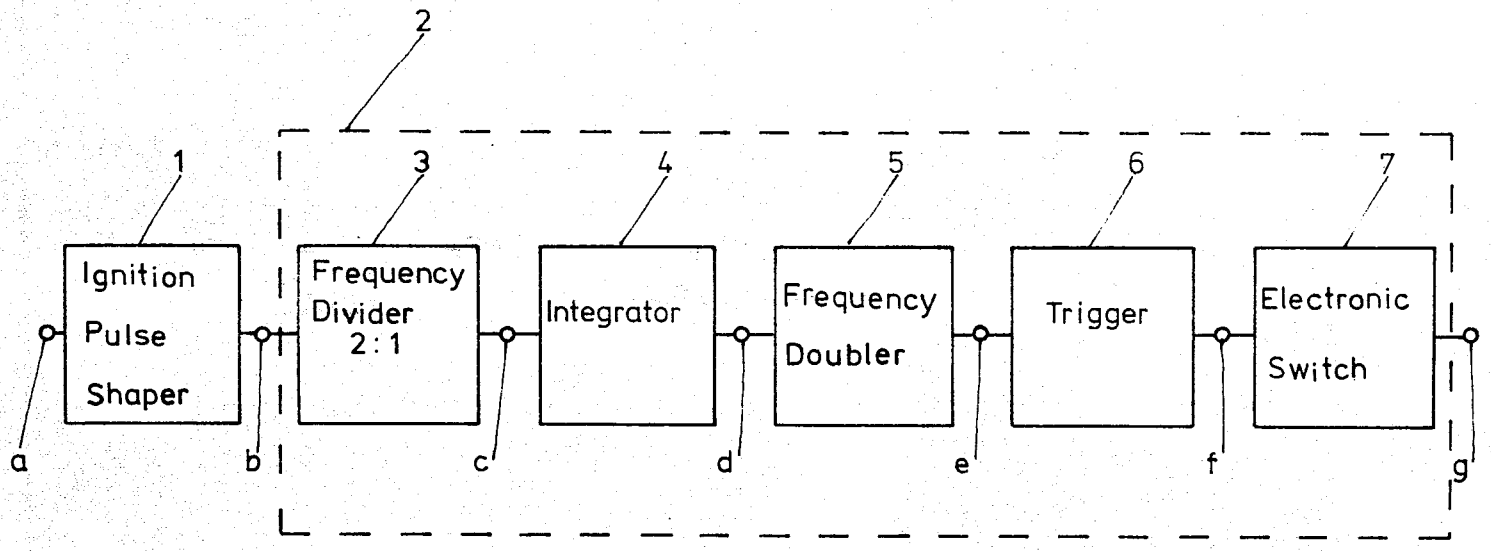
FIG. 1 is a block diagram of an electronic circuit according to a preferred embodiment of the present invention.

The preferred embodiments of the present invention will now be described in connection with FIGS. 1–3. Identical elements and signals which are illustrated in these three figures are designated with the same reference numerals.

Turning first to FIG. 1, it will be assumed that the input terminal to the entire apparatus receives a signal *a* comprised of pulses that are either directly derived from the ignition pulses in a manner known in the art, or are generated by one or more separate contacts added to the distributor. An exemplary pulse train *a* is illustrated in the first signal diagram in FIG. 3.

The input pulse train *a* in the embodiment of FIG. 1 is applied to an ignition pulse shaper 1. The pulse shaper 1 produces output pulses *b* which correspond in duration to the input pulses *a*, as shown in FIG. 3. The pulse train *b* is then supplied to a signal processor 2, in accordance with the invention, which acts to reduce any short-duration changes in the interval or period between successive pulses in the pulse train *b*.

The signal processor 2 comprises, at its input side, a pulse frequency divider which, in this exemplary embodiment, reduces the pulse frequency by a ratio of 2:1. As illustrated in the third signal diagram in FIG. 3, the pulse frequency divider is designed in such a way that each individual pulse of the pulse train *c* is initiated by the leading edge of a corresponding pulse in the pulse train *b* and is terminated by the leading edge of the nextfollowing pulse in the pulse train *b*.

Figure 3:
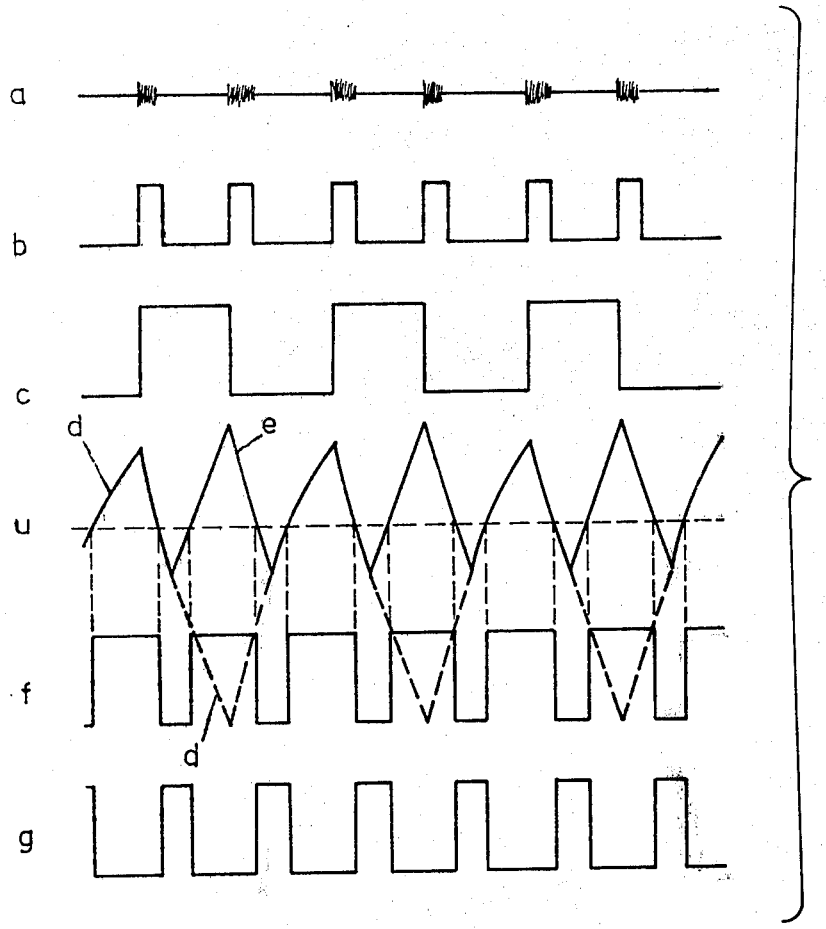
FIG. 3 is a signal diagram illustrating various signals which may appear in the circuit of FIGS. 1 and 2.

The pulse train *c*, with the reduced pulse frequency, is applied to an integrator 4 causing it to repeatedly charge and discharge, and thus produce an output signal *d*, as shown in FIG. 3. The signal *d* is passed to a frequency doubler 5 which inverts the portions of the integrator output signal *d* that are indicated in FIG. 3 by broken lines. The output of the frequency doubler 5 therefore follows a curve *e*, as indicated in FIG. 3, the fundamental frequency of which again corresponds to the pulse frequency of pulse trains *a* and *b*.

When the signal *e* exceeds a given trigger voltage U (see the fourth signal diagram in FIG. 3), a so-called trigger or threshold circuit 6 produces an output signal of prescribed voltage, thereby generating a pulse train *f*. The signal *f* is inverted by an electronic switch 7 to produce the output *g* of the signal processor 2. The pulse train *g*, which contains RPM-dependent control pulses, may then be applied to the regulator of an electronic fuel injection system.

Depending upon the sign and impedance required for the output signal *g*, it may be possible to omit the electronic switch 7 from the signal processor 2.

Because of the shape of the charge and discharge curves *d* and *e*, short-duration interval variations, such as occur only between successive pulses of the pulse trains *a* and *b*, result in only negligible variations in the positions in time of the pulses of the output signals *f* or *g*. Therefore such interval variations cannot produce an undesirable controlling action in the electronic fuel injection regulator.

On the other hand, longer lasting variations in speed and, accordingly, variations in the intervals between pulses of the pulse trains *a* and *b* cause a modification of the general potential in the integrator 4 resulting in a variation of the intervals between pulses *g* of the output signal as required to effect a controlling action.

Figure 2:
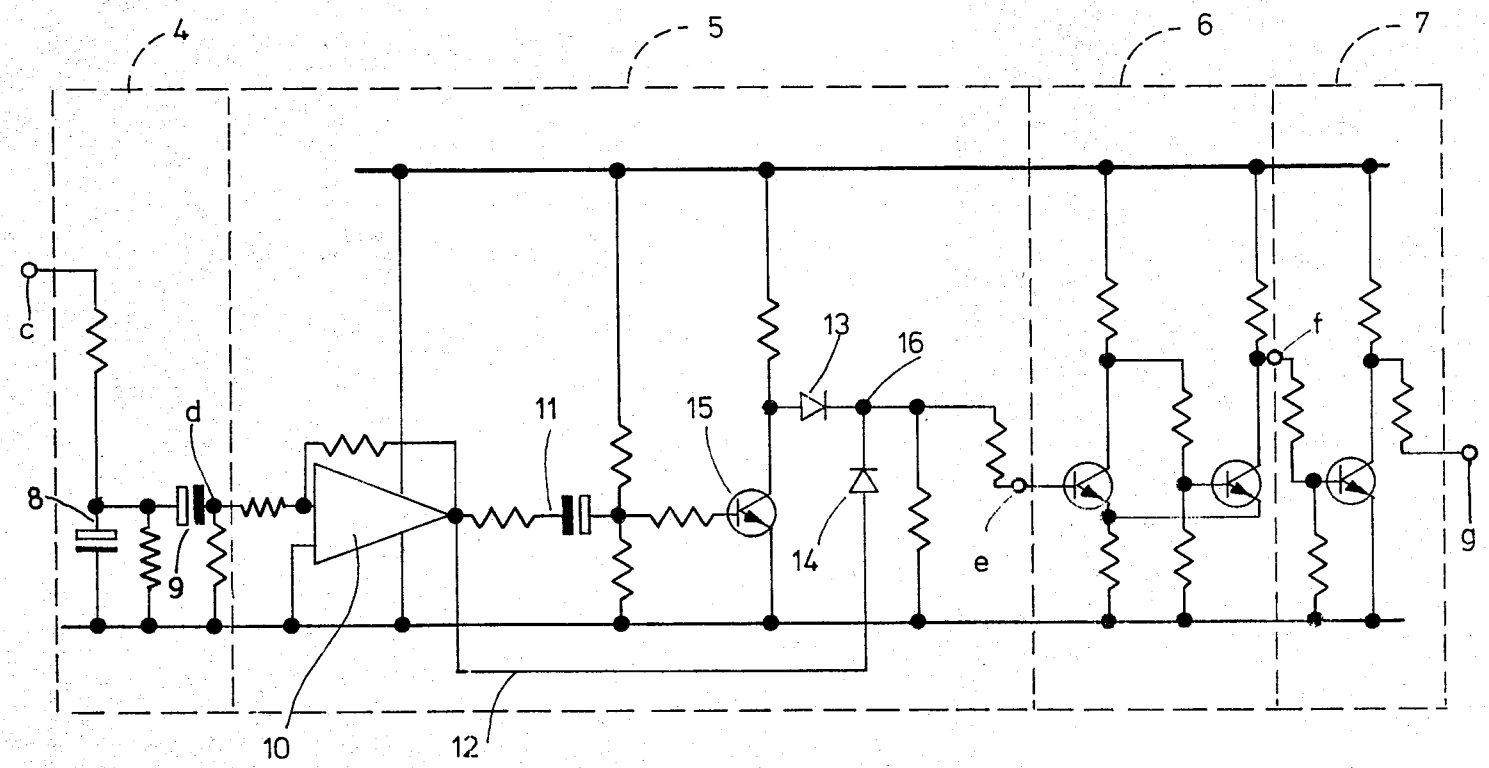
FIG. 2 is a schematic diagram of a portion of the circuit shown in FIG. 1.

FIG. 2 illustrates in detail certain circuits which may be used to realize the various elements in the embodiment of the invention shown in FIG. 1. Specific circuits for the pulse shaper 1 and the frequency divider 3 which are well known in the art have not been included; however, the remaining elements of FIG. 1 are indicated in dashed lines in FIG. 2.

Pulses arriving from the pulse frequency divider 3 are applied to a capacitor 8 of the integrator 4. The voltage across the capacitor 8 is supplied as an input via a capacitor 9 to an operational amplifier 10 of the frequency doubler 5. Two branches 11 and 12 of the frequency doubler, each containing a diode 13 and 14, respectively, are connected in parallel to the operational amplifier 10 which functions as an amplifier and an inverter. The branch 11 is provided with a transistor 15 that inverts the portions of the voltage signal *d* that are indicated by broken lines in FIG. 3. The branches 11 and 12 are coupled at the circuit point 16 to obtain the voltage signal *e*, indicated by solid lines in FIG. 3, having twice the pulse frequency of the voltage signal *d*.

The voltage or pulse signal *e* is applied to the trigger circuit 6, which in this case is constructed as a well-known Schmitt trigger. Output pulses *f* from the trigger circuit 6 are forwarded to the electronic switch 7 which functions as an inverting amplifier. The final output pulse train *g* of the signal processor 2 in accordance with the invention is applied as an input to an electronic fuel injection control device or regulator. The switching stage 7, which, as mentioned above, may be omitted if desired, serves primarily to match the output impedance of the signal processor to that of the input of the control device.

It will be understood that the present invention is susceptable to various changes, modifications and adaptations as will occur to those skilled in the art. For example, in the embodiment of the signal processor according to the invention illustrated in FIGS. 1–3 and described above, three pulses are combined to form a pulse sequence and the mean value of the two intervals between the three pulses is formed. It is also possible to combine a larger number of pulses to form this pulse sequence so that more intervals are averaged by the integrator. In such a case, several pulse frequency dividers and doublers of the types described may be connected in series. Clearly it is also possible to design the individual components of the circuit in a different manner; for example, the pulse frequency doubler may be formed by two operational amplifiers connected in parallel, with subsequent rectifiers, whereby only one of the amplifiers is connected as an inverter.

Accordingly, it is intended that the scope of the present invention be limited only by the following claims.

We claim:

1. An electronically controlled fuel injection system comprising, in combination:

a. signal generating means for producing a first train of pulses in which the pulse intervals are dependent upon engine RPM;

b. signal processing means, connected to said signal generating means, for producing a second train of pulses in which the pulse intervals are dependent, at least approximately, upon the mean value of pulse intervals in said first pulse train within a given pulse sequence, thereby at least reducing pulse interval changes of short duration, said signal processing means including:

1. pulse frequency divider means connected to said signal generating means;
2. integrator means connected to said pulse frequency divider means;
3. pulse frequency multiplier means connected to said integrator means, said pulse frequency divider means and said pulse frequency multiplier means having the same factor of division and multiplication, respectively, so that the output of said pulse frequency multiplier means exhibits approximately the same pulse frequency as said first pulse train; and
4. trigger means, connected to said pulse frequency multiplier means, for producing an output signal whenever the input thereto reaches a prescribed value; and c. fuel injection means, connected to said signal processing means, for injecting fuel into an internal combustion engine upon receipt of said pulses of said second pulse train.

2. The apparatus defined in claim 1, wherein said pulse frequency multiplier means includes at least one pulse frequency doubler, connected to said integrator means, said pulse frequency doubler having two output-coupled rectifying branches, one of which contains means for inverting the integrated voltage output of said integrator means.

* * * * *